United States Patent [19]

Horie

[11] Patent Number: 4,796,328

[45] Date of Patent: Jan. 10, 1989

[54] ERASER

[75] Inventor: Fumio Horie, Tokyo, Japan

[73] Assignee: Horie Sangyo Kabushiki Kaisha, Tokyo, Japan

[21] Appl. No.: 133,565

[22] Filed: Dec. 16, 1987

[30] Foreign Application Priority Data

Dec. 18, 1986 [JP] Japan ..... 61-302631

[51] Int. Cl.[4] ..... B43L 19/00

[52] U.S. Cl. ..... 15/424

[58] Field of Search ..... 15/424

[56] References Cited

U.S. PATENT DOCUMENTS 328,778 10/1885 Holton ..... 15/424

FOREIGN PATENT DOCUMENTS 1443536 5/1966 France ..... 15/424
6035063 9/1976 Japan ..... 15/424
2042898 2/1987 Japan ..... 15/424

*Primary Examiner*—Chris K. Moore

*Attorney, Agent, or Firm*—Hedman, Gibson, Costigan & Hoare

[57] ABSTRACT

An eraser capable of erasing characters and the like written on paper with a ball-point pen, fountain pen, typewriter, word processor, color pencil or the like. The eraser has an integral structure composed of plural types of eraser pieces having different hardnesses and an abrasive material, the eraser pieces and the abrasive material existing respectively in a particulately dispersed state. A method for manufacturing such eraser comprises steps of kneading plural types of major eraser materials which have been previously vulcanized and shaped at need with an abrasive material and vulcanizing and shaping the resulting mixture. These plural types of major eraser materials are such that erasers having different hardnesses can be produced if each of the major eraser materials is either vulcanized or heated and shaped alone and that particles of the major eraser materials exist independently from one another even if these materials are kneaded.

4 Claims, 3 Drawing Sheets

ERASER

BACKGROUND OF THE INVENTION

This invention relates to an eraser, ability of which for erasing characters and the like on a paper written with ball-point pen, fountain pen, typewriter, word processor, color pencils or the like is improved, and to a method for manufacturing such improved eraser.

A so-called sand-containing eraser has been heretofore known as an eraser for erasing characters and the like written on a paper with ball-point pen, fountain pen or the like. A conventional sand-containing eraser is manufactured in such a manner that a factice (white factice), a plasticizer, and a mineral oil are mixed homogeneously with rubber or plastic, a major component, to which is added an abrasive material having a particle size of about 150 emery, carborundum (black silicon carbide) or the like, the resulting admixture is kneaded by the use of rolls or the like, and the product thus kneaded is either vulcanized or heated and shaped.

The structure of the shaped eraser is shown in FIG. 2 wherein particles of an abrasive material 12 are dispersed and included in a homogeneous major eraser material 10.

In said conventional sand-containing eraser, if the major eraser material 10 is a soft material, such major eraser material does not present suitable stiffness to sustain particles of the abrasive material 12 as shown in FIG. 3 in the case when the eraser itself is pressed against the surface of a paper 14. Thus, such eraser cannot scrape the ink 16 bonded to the paper surface 14 therefrom so that such conventional eraser has poor erasing ability.

On the other hand, if the major eraser material 10 is a hard material, such hard major eraser material 10 cannot be in close contact with the paper surface 14 as shown in FIG. 4. Accordingly, if there is a minute irregularity on the paper surface 14, particles of the abrasive material 12 included in such hard eraser cannot fit into the minute irregularity so that the abrasive material particles 12 cannot scrape off the ink 16 on the paper surface 14. In this case, it is required to scrape off the paper 14 itself up to such a depth corresponding to that where the ink 16 exists, so that there is such a disadvantage that the paper 14 is damaged by such hard eraser in the case where a soft paper is used, whilst if a hard paper is employed, the paper 14 cannot be scraped off by the eraser so that the ink 16 on the paper surface remains unerased.

In view of the above, the present invention contemplates to eliminate disadvantages involved in the above described prior art and to provide an improved eraser through the use of which damage of a paper to be erased decreases, besides erasing ability of the eraser is elevated, as well as a method for manufacturing such improved eraser.

SUMMARY OF THE INVENTION

The present invention relates to an eraser having an integral structure composed of plural types of eraser pieces having different hardnesses and an abrasive material, said eraser pieces and said abrasive material existing in a particulately dispersed state.

Furthermore, the present invention relates also to a method for manufacturing an eraser comprising the steps of kneading plural types of major eraser materials which have been previously vulcanized and shaped at need with an abrasive material, and vulcanizing and shaping the resulting mixture, said plural types of major eraser materials are such that erasers having different hardnesses can be produced if each of said plural types of major eraser materials is either vulcanized or heated and shaped alone and that particles of said plural types of major eraser materials exist independently from one another even if these materials are kneaded.

According to the eraser of the present invention, when the eraser is pressed against the surface of a paper to be erased, soft eraser pieces in said eraser deform in conformity with a minute irregularity on said paper surface resulting in close contact of the entire eraser with paper. In this case, the abrasive material is forcibly pressed against the paper surface by means of hard eraser pieces to scrape out ink bonded on said paper surface. Thus, even if there is a minute irregularity on the paper surface, said paper surface can be sufficiently rubbed with the eraser according to the invention along the irregular surface thereof, so that only the ink can be removed without substantial damage of the paper surface.

Furthermore, said improved eraser can be obtained in accordance with the manufacturing method of the present invention.

DESCRIPTION OF PREFERRED EMBODIMENTS

Figure 1:
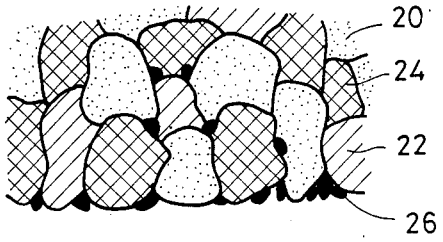
FIG. 1 is an enlarged sectional view showing an example of the eraser according to the present invention.
Figure 4:
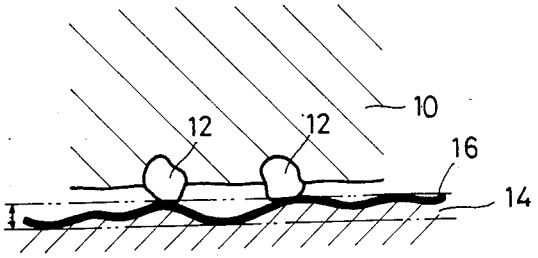
FIGS. 3 and 4 are sectional views each illustrating a state of a paper in the case where the sand-containing eraser of FIG. 2 is pressed against the surface of the paper.
Figure 2:
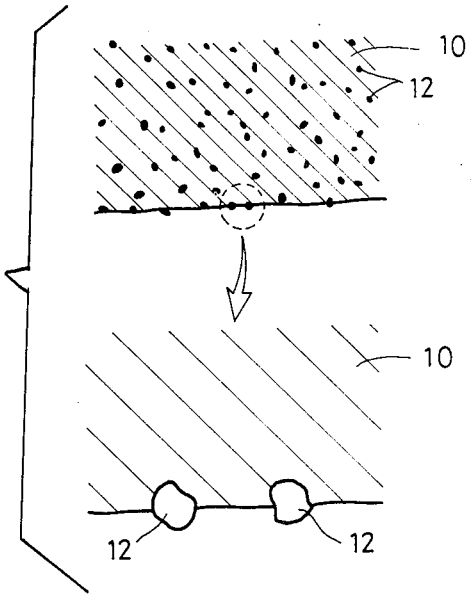
FIG. 2 is a sectional view as well as a partially enlarged view thereof each showing a conventional sand-containing eraser.
Figure 3:
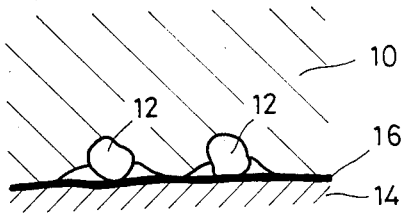

An embodiment of the eraser according to the present invention is shown in FIG. 1 in an enlarged manner wherein an example where the eraser itself is prepared from three types of erasers. More specifically, this eraser is integrally composed of soft eraser pieces 20, medium eraser pieces 22, hard eraser pieces 24, and an abrasive material 26 in a particulately dispersed form.

Figure 5:
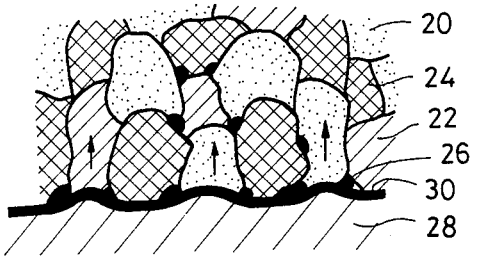
FIG. 5 is a sectional view illustrating a state of a paper in the case where the eraser of FIG. 1 is pressed against the surface of the paper.

When the eraser is pressed against the surface of a paper, the front of the eraser comes into close contact with the paper surface 28 as a result of deformation of the soft eraser pieces 20 in conformity with a minute unevenness of the paper surface 28 as shown in FIG. 5. At the same time, the abrasive material 26 is strongly pressed upon the paper surface 28 by means of the hard eraser pieces 24 to scrape off ink 30 which has adhered to the paper surface 28. Thus, even if there is a minute unevenness on the paper surface 28, the surface of the paper can be rubbed with the eraser along the unevenness thereof, so that only the ink 30 can be removed without damaging significantly the paper surface 28.

EXAMPLE 1

An example of a method for manufacturing the eraser shown in FIG. 1 will be described hereinbelow.

In Example 1, three types of materials for the eraser, i.e. hard, medium, and soft materials are used as the major eraser materials. Material 1 (the eraser 20) is a particularly soft material, material 2 (the eraser 22) is one having substantially the same hardness with that of ordinary raw rubber, and material 3 (the eraser 24) is a hard material. In the case where only two types of hard and soft materials are used and in addition, there is a remarkable difference between both the materials in their hardnesses, they are hard to be miscible even though they are kneaded. However, when a material having a medium hardness is introduced into the mixture of both the hard and soft materials, these components become easy to be miscible. When these major eraser materials 1–3 are independently vulcanized and shaped, each of the resulting erasers produces residuary substances as a result of friction with the surface of a paper. Furthermore, even if these major eraser materials are kneaded by means of rolling or the like operations, they do not fuse one another, but are dispersed into the resulting product due to adhesion of rubber to exist in the form of particles without any accompanying change in their properties of the respective materials, and hence these eraser materials are integrally composed as a whole.

First, three types of major eraser materials 1, 2, 3 and an abrasive raw material as well as a method for manufacturing an eraser will be described hereinbelow.

(1) Material 1 (especially soft material)

The material 1 is prepared from the following respective ingredients A–H as the raw materials. All parts given in the the following description are by weight unless otherwise indicated.

| | | |
|---|---|---|
| A: | TCEP (manufactured by Kurogane Chemical Co.) (trichloroethyl phosphate) | 38 parts |
| B: | Nipol 1312 (manufactured by Nippon Zeon Co.) (moderately high nitrile content - liquid) | 22 parts |
| C: | Nipol 1042 (manufactured by Nippon Zeon Co.) (moderately high nitrile content) | 40 parts |
| D: | Sulfur | 2 parts |
| E: | Chinese white | 0.3 part |
| F: | Vulcanizing accelerator | 0.9 part |
| G: | Calcium carbonate | 6 parts |
| H: | Titanium white | 1.5 parts |

A ratio of ingredients A, B and C may be varied within a range in which when the upper limit of ingredient A is 68 parts, ingredients B and C are 22 parts and 10 parts, respectively, whilst when the lower limit of ingredient A is 18 parts, ingredients B and C are 22 parts and 60 parts, respectively.

As ingredient A, plasticizers other than trichloroethyl phosphate such as dioctyl phthalate, dibutyl phthalate and the like which are well miscible with ingredients B and C and are vulcanizable may be used either alone or in combination of several plasticizers.

Chinese white of ingredient E is one for accelerating subsidiarily the vulcanization.

Calcium carbonate of ingredient G is used for increasing hardness of the material 1.

Ingredient A is a plasticizer which softens especially the material 1 and produces also residuary substances due to friction with the surface of a paper. Furthermore, ingredient A is liquid which dissolves well various resins, and particularly ink for ball-point pen. When ingredient A is applied on the surface of a paper without any modification, the ingredient A dissolves the ink for ball-point pen on the paper and the dissolved ink blots on this paper. However, when ingredient A is kneaded with the other ingredients in material 1, the ingredient A is dispersed into the material 1. Thus, ingredient A contributes to release rapidly the ink adhered closely to the surface of a paper, when the paper surface is rubbed with such an eraser containing the material 1 after vulcanization.

While it is required to previously vulcanize only material 1 among materials 1–3, this is because ingredients of the material 1 fuse into the other materials 2 and 3, if the material 1 is kneaded with materials 2 and 3 without previously vulcanizing the material 1. In this respect, previous vulcanization is not required for materials 2 and 3, because ingredients which do not fuse with the other ingredients even if the materials 2 and 3 have not been previously vulcanized are utilized. Even though material 1 has previously been vulcanized, so vulcanized material 1 can be miscible with other materials 2 and 3 through kneading for them, because the material 1 is a soft material.

Material 1 is prepared in such a manner that all the ingredients A–H described above are blended at a stretch, the blend is kneaded by the use of a kneader, a three-roll mill or the like, and the kneaded ingredients are vulcanized in accordance with an ordinary rubber vulcanizing procedure.

The finished material 1 is particularly soft, and when the surface of a paper is rubbed with the material 1, residuary substances are produced from the material 1 so that it serves as an eraser.

(2) Material 2 (one having a hardness which is substantially the same with that of raw rubber)

The material 2 is prepared from the following respective ingredients A–G as the raw materials.

| | | |
|---|---|---|
| A: | Nipol DN002 (manufactured by Nippon Zeon Co.) (acrylonitrile copolymer with extremely high nitrile content) | 86 parts |
| B: | Nipol 1312 (manufactured by Nippon Zeon Co.) (moderately high nitrile content - liquid) | 14 parts |
| C: | Methyl ethyl ketone | 1.5 parts |
| D: | Sulfur | 1.5 parts |
| E: | Chinese white | 0.5 part |
| F: | Vulcanizing accelerator | 0.8 part |
| G: | Titanium white | 4 parts |

A ratio of ingredients A and B may be varied within a which when the upper limit of ingredient A is 95 parts, ingredient B is 5 parts, whilst when the lower limit of ingredient A is 70 parts, ingredient B is 30 parts.

Ingredient A has been previously masticated (without adding ingredients B–G). As a result of such previous mastication, the ingredient A becomes easily miscible with ingredient B. Ingredient C is used for mixing ingredient A together with ingredient B, and which may be any solvent other than methyl ethyl ketone so far as it evaporates and is common to ingredients A and B.

Ingredient A does not exhibit essentially perfect miscibility with respect to ingredient B (they do not form fine particles), but when ingredient C is added to both the ingredients A and B, they become miscible one another. As described above, when such ingredients which are essentially immiscible are forcibly mixed together, a fragile product is produced. Accordingly, when the surface of a paper is rubbed with such product, residuary substances produce so that the product serves as an eraser. As a result of containing a large amount of factice, plasticizer, mineral oil and the like, conventional erasers produce residuary substances. In the eraser according to the present invention, however, even if a small amount of a factice, a plasticizer, a mineral oil and the like are added to the material 2, ingredients of the materials 1–3 are easily mixed together so that the materials 1–3 cannot exist as independent particles in the final product. Thus, all the ingredients of the respective materials 1–3 are united together, so that the resulting eraser has a significantly poor erasing ability.

When material 2 is prepared from the ingredients A–G as described above, materials 1–3 can exist as independent particles in the final product, respectively, so that such final product can produce residuary substances in use. It is to be noted that one part or more of ingredient C is sufficient for mixing together ingredients A and B.

Material 2 is prepared as follows. To the ingredient A which has been previously masticated are added ingredients B and C, the resulting mixture is sealed and allowed to stand for about 12 hours, and then ingredients D–G are added thereto and milled while effecting roll milling. While substantially all the ingredient C evaporates during the rolling, another air-drying for three days is preferable. There is no problem as to final products even if a small amount of ingredient C remains in the material 2.

(3) Material 3 (hard material)

The material 3 is prepared from the following respective ingredients A–G as the raw materials.

| | | |
|---|---|---|
| A: | Nipol 2007J (manufactured by Nippon Zeon Co.)(high styrene content copolymer - styrene:butadiene = 85:14) | 100 parts |
| B: | Polyethylene glycol No. 200 (manufactured by Nippon Oils and Fats Co.)(liquid - molecular weight 200) | 6.5 parts |
| C: | Methyl ethyl ketone | 14 parts |
| D: | Sulfur | 1.6 parts |
| E: | Chinese white | 0.3 part |
| F: | Vulcanizing accelerator | 0.6 part |
| G: | Titanium white | 2 parts |

The respective upper limits of the ingredients A, B and C used for preparing material 3 are 100 parts, 9.5 parts, and 20 parts, whilst the lower limits thereof are 100 parts, 3 parts, and 10 parts, respectively. In ingredient A, a content of styrene may be selected within a range of from 75 to 90%, and the higher content of styrene results in the harder material 3. As ingredient B, liquid polyethylene glycol having a molecular weight of up to about 600 may be used.

Ingredient B dissolves well ink for ball-point pen, and it serves to accelerate erasing function of ball-point pen marks. When ingredient B is applied on the surface of a paper without any modification, the ingredient B dissolves the ink for ball-point pen on the paper and the dissolved ink blots on this paper. However, when ingredient A is mixed with ingredient B, the latter is dispersed into material 3. Thus, ingredient B contributes to release rapidly the ink adhered closely to the surface of a paper, when the paper surface is rubbed with such an eraser containing the material 3 after vulcanization.

Ingredient A does not exhibit essentially perfect miscibility with respect to ingredient B, but when ingredient C being a solvent common to both the ingredients A and B is added to them, they become miscible one another. This is the same theory with that relating to said material 2 wherein the ingredient A is allowed to be miscible with the ingredient B with the aid of the ingredient C. As described above, when such immiscible ingredients A and B are forcibly mixed together, a fragile product is produced. Accordingly, when the surface of a paper is rubbed with such product, residuary substances produce so that the product serves as an eraser.

As mentioned above, as a result of containing a large amount of factice, plasticizer, mineral oil and the like, conventional erasers produce residuary substances. In the eraser according to the present invention, however, even if a small amount of a factice, a plasticizer, a mineral oil and the like are added to the material 3, ingredients of the materials 1–2 are easily mixed together so that the materials 1–3 cannot exist as independent particles in the final product. Thus, all the ingrediants of the respective materials 1–3 are united together, so that the resulting eraser cannot produce residuary substances and exhibits no erasing ability of pencil marks.

When material 3 is prepared from the ingredients A, B, and C as described above, materials 1–3 can exist as independent particles in the final product, respectively, so that such final product can produce residuary substances in use, and a hard eraser can thus be obtained.

Ingredient D (sulfur) is used for vulcanizing and shaping mixed materials 1–3 at the final stage.

Ingredient G (titanium white) is a pigment for coloring the final product.

Material 3 is prepared in such a manner that a well blended mixture obtained by adding ingredient B to ingredient C is introduced into ingredient A, the resulting admixture is sealed and allowed to stand for about 6 hours, then ingredients D–G are added thereto, and the mixture is milled by the use of rolls. While the ingredient C (methyl ethyl ketone) contained in material 3 evaporates considerably during the rolling, another air-drying for five days is preferable. There is no problem as to final products even if a small amount of ingredient C remains in the material 3. The material 3 is particularly hard so that when only such material is vulcanized, the hardness of the resulting product is such that the surface thereof cannot be scratched by user's nail.

(4) Abrasive material (material 4)

The abrasive material is prepared from the following ingredients A and B as the raw materials.

| | | |
|---|---|---|
| A: | WA 320 (manufactured by Fujimi Abrasive Material Industry)(white aluminum oxide - 320 mesh) | 100 parts |
| B: | Polyethylene glycol solution (polyethylene glycol - molecular weight 20,000:water = 5:95) | 25 parts |

As ingredient B, such polyethylene glycol having a molecular weight of about 1540 as the lower limit may be used. As to a ratio of polyethylene glycol with respect to water, the upper limit of which is polyethylene glycol having a molecular weight of 20,000:water = 10:90, whilst the lower limit is 2:98. Any material having a particle size of about 320 mesh as well as high water absorbing capacity may be used as ingredient A.

When ingredient A is mixed with materials 1–3 without any modification, the materials 1–3 are closely adhered to the ingredient A, so that residuary substances are difficult to produce in the case when the surface of a paper is rubbed with the resulting eraser and its erasing ability decreases. However, when ingredient B being a lubricating material is bonded to ingredient A, the materials 1–3 become hard to closely adhere one another so that residuary substances produce easily. Furthermore, since ingredient B being polyethylene glycol having a molecular weight of 20,000 exhibits slippage as in paraffin, when the ingredient B is bonded to ingredient A, damage of the surface of a paper to be erased can be considerably reduced. Relating to ingredient A, although an abrasive material of about 150 mesh has been used in ordinary sand-containing erasers, the surface of a paper to be erased is significantly damaged by a sand-containing eraser containing an abrasive material of such mesh. According to the erasers of the present invention, a particle size of the abrasive material may be within a range of about 150–about 500 mesh, and preferably about 320–about 400 mesh so that damage of the paper surface erased can be reduced, besides erasing ability of such eraser is favorable.

The abrasive material of the present invention is prepared as follows. Ingredient B is added to ingredient A, and the mixture is heated in a water bath for about 20 minutes to expel moisture in the ingredient B in the form of a solution. The mixture so heated is treated at around 140° C. for about 25–40 minutes by the use of a dryer, and the ingredient B is allowed to permeate sufficiently into the ingredient A.

As the ingredient B being a lubricating material, a solution prepared by dissolving, for example, a releaser silicone into polyethylene glycol with the use of water, a solution prepared by dissolving an aliphatic acid into polyethylene glycol with the use of an emulsifier, a solution prepared by dissolving stearic acid into polyethylene glycol with the use of methyl ethyl ketone, or the like solution may also be employed. In case of using these solutions, each ingredient B is allowed to bond to or permeate into an abrasive material, and then the corresponding solvent (water, emulsifier, or methyl ethyl ketone) is permitted to evaporate from the corresponding solution.

After preparing materials 1–3 of a major eraser material and an abrasive material (material 4) as described above, the following stages are practiced as the final process to obtain a product.

(1) First Stage

The following materials are milled by rolls.

Material 2: 21 parts
Material 3: 43 parts

In case of kneading materials 2 and 3 by means of rolls, size of particles of the respective materials 1–3 varies dependent upon a gap defined between the rolls. In the case when the rolls are set at the narrowest gap, an irregularity on the surface of the resulting product decreases, whilst when such gap is 2–3 mm, a product with a considerable irregularity is obtained.

(2) Second Stage

The following materials are milled by rolls.

| | |
|---|---|
| The materials milled in the first stage: | 64 parts |
| Material 1: | 57 parts |

(3) Third Stage

The following materials are milled by rolls.

| | |
|---|---|
| The materials milled in the second stage: | 121 parts |
| Abrasive material (material 4): | 97 parts |

It is preferred that a ratio of the abrasive material (material 4) with respect to the total major eraser material obtained in the second stage is about 75–about 80%.

(4) Fourth Stage

The materials milled in the third stage are vulcanized and shaped to obtain products as in the case of general rubber products.

In the products thus obtained, the materials 1–3 constituting eraser itself exist in the form of particles and a particle size of which is larger than that of the abrasive material (material 4).

| | |
|---|---|
| (Case 1) | |
| Material 1 | 55 parts |
| Material 2 | 23 parts |
| Material 3 | 46 parts |
| Material 4 (abrasive material) | 97 parts |
| (Case 2) | |
| Material 1 | 52 parts |
| Material 2 | 25 parts |
| Material 3 | 46 parts |
| Material 4 (abrasive material) | 97 parts |
| (Case 3) | |
| Material 1 | 49 parts |
| Material 2 | 27 parts |
| Material 3 | 46 parts |
| Material 4 (abrasive material) | 97 parts |

EXAMPLE 2

Another example of the method for manufacturing the eraser shown in FIG. 1 according to the present invention will be described hereinbelow. In also Example 2, the materials to be used and the manufacturing steps therefor are essentially the same with those of Example 1 except that moderately high content nitrile of the ingredient C in the material 1 of Example 1 is omitted in Example 2. Furthermore, calcium carbonate of the ingredient F serves for preventing precipitation of sulfur and chinese white in case of the vulcanization.

In Example 2, sulfur, chinese white, vulcanizing accelerator, and titanium white of the ingredients D–G in the material 2 are not introduced into the material 2, but added at the final stage.

Moreover, as to a compounding ratio of the materials 1 and 2 at the final stage, a ratio of the material 2 is made larger than that of Example 1.

Three types of major eraser materials 1, 2, 3 and an abrasive raw material as well as a method for manufacturing an eraser in Example 2 will be described hereinbelow.

(1) Material 1 (especially soft material)

The material 1 is prepared from the following respective ingredients A–F as the raw materials. All parts given in the following description are by weight unless otherwise indicated.

| | |
|---|---|
| A: TCEP (manufactured by Kurogane Chemical Co.) (trichloroethyl phosphate) | 67 parts |
| B: Nipol 1312 (manufactured by Nippon Zeon Co.) | 33 parts |

-continued

| | | |
|---|---|---|
| | (moderately high nitrile content - liquid) | |
| C: | Sulfur | 3.3 parts |
| D: | Chinese white | 0.8 part |
| E: | Vulcanizing accelerator | 0.2 part |
| F: | Calcium carbonate | 13 parts |

A ratio of ingredients A and B may be varied within a range in which when the upper limit of ingredient A is 88 parts, ingredient B is 12 parts, whilst when the lower limit of ingredient A is 21 parts, ingredient B is 79 parts.

As an ingredient A, plasticizers other than trichloroethyl phosphate such as dioctyl phthalate, dibutyl phthalate and the like which are well miscible with ingredient B and vulcanizable may be used either alone or in combination of several plasticizers.

Calcium carbonate of the ingredient F serves herein for preventing precipitation of sulfur and chinese white in case of the vulcanization.

Material 1 is prepared in such a manner that all the ingredients A–F described above are blended at a stretch, the blend is kneaded by the use of a kneader, a three-roll mill or the like, and the kneaded ingredients are vulcanized in accordance with an ordinary rubber vulcanizing procedure.

The finished material 1 is particularly soft, and when the surface of a paper is rubbed with the material 1 residuary substances are produced from the material 1 so that it serves as an eraser.

(2) Material 2 (one having a hardness which is substantially the same with that of raw rubber)

The material 2 is prepared from the following respective ingredients A–C as the raw materials.

| | | |
|---|---|---|
| A: | Nipol DN002 (manufactured by Nippon Zeon Co.) (acrylonitrile copolymer with extremely high nitrile content) | 80 parts |
| B: | Nipol 1312 (manufactured by Nippon Zeon Co.) (moderately high nitrile content - liquid) | 20 parts |
| C: | Methyl ethyl ketone | 10 parts |

Ingredient A has been previously masticated (milled without adding sulfur). As a result of such previous mastication, the ingredient A becomes easily miscible with ingredient C. Ingredient C is used for mixing ingredient A together with ingredient B, and which may be any solvent other than methyl ethyl ketone so far as it dissolves A and evaporates by itself.

It is to be noted that one part or more of methyl ethyl ketone is sufficient for mixing together ingredients A and B.

Ingredient A does not exhibit essentially perfect miscibility with respect to ingredient B (they do not form fine particles), but when ingredient C is added to both the ingredients A and B, they become miscible one another.

A ratio of ingredients A, B and C may be varied within a range in which when the upper limit of ingredient A is 95 parts, ingredients B and C are 5 parts and 10 parts, respectively, whilst when the lower limit of ingredient A is 60 parts, ingredients B and C are 40 parts and 10 parts, respectively.

In case of preparing material 2, first, ingredient C is added to ingredient A, the resulting mixture is sealed and allowed to stand for about 12 hours, and then ingredient B is added thereto and milled sufficiently while effecting roll milling. The resulting mixture thus kneaded is heated in a water bath or air-dried to obtain material 2. A hardness of the finished material 2 is substantially the same with that of an ordinary raw rubber.

(3). Material 3 (hard material)

The material 3 is prepared from the following respective ingredients A–G as the raw materials.

| | | |
|---|---|---|
| A: | Nipol 2007J (manufactured by Nippon Zeon Co.) (high styrene content copolymer - styrene:butadiene = 85:15) | 92 parts |
| B: | Polyethylene glycol No. 200 (manufactured by Nippon Oils and Fats Co.)(liquid - molecular weight 200) | 8 parts |
| C: | Methyl ethyl ketone | 25 parts |
| D: | Sulfur | 2 parts |
| E: | Chinese white | 0.5 part |
| F: | Vulcanizing accelerator | 0.5 part |
| G: | Titanium white | 4 parts |

Ingredient C, which functions similarly to the ingredient C in material 2, is used for mixing ingredient A together with ingredient B, and which may be any solvent other than methyl ethyl ketone so far as it dissolves A and evaporates by itself.

In ingredient A, a content of styrene may be selected within a range of from 80 to 93%, and the higher content of styrene results in the harder material 3.

As ingredient B, liquid polyethylene glycol having a molecular weight of up to about 600 may be used.

Ingredient A does not exhibit essentially perfect miscibility with respect to ingredient B, but when ingredient C is added to them, they become miscible one another.

A ratio of ingredients A, B and C may be varied within a range in which when the upper limit of ingredient A is 97 parts, ingredients B and C are 3 parts and 25 parts, respectively, whilst when the lower limit of ingredient A is 87 parts, ingredients B and C are 13 parts and 25 parts, respectively.

In case of preparing material 3, a well blended mixture obtained by adding ingredient B to ingredient C is introduced into ingredient A, the resulting admixture is sealed and allowed to stand for about 3 hours, then is simply milled by the use of rolls and air-dried, thereafter the resulting product is substantially subjected to roll milling.

The material 3 is particularly hard so that when only such material is vulcanized, the hardness of the resulting product is such that the surface thereof cannot be scratched by user's nail.

(4) Abrasive material (material 4)

The abrasive material is prepared from the following ingredients A and B as the raw materials.

| | | |
|---|---|---|
| A: | WA 320 (manufactured by Fujimi Abrasive Material Industry)(white aluminum oxide - 320 mesh) | 100 parts |
| B: | Polyethylene glycol solution (polyethylene glycol - molecular weight 20,000:water = 1:13) | 20 parts |

Any material having a particle size of about 320 mesh as well as high water absorbing capacity may be used as ingredient A.

The abrasive material of the present invention is prepared as follows. Ingredient B is added to ingredient A, and the mixture is heated in a water bath for about 20 minutes to expel moisture in the ingredient B. The mixture so treated is heated at around 140° C. for about 40 minutes by the use of a dryer, and the ingredient B is allowed to permeate sufficiently into the ingredient A.

According to the erasers of the present invention, a particle size of the ingredient A may be within a range of about 150–about 500 mesh, and preferably about 320–about 400 mesh so that damage of the paper surface erased can be reduced, besides erasing ability of such eraser is favorable.

As ingredient B, such polyethylene glycol having a molecular weight of about 1540 as the lower limit maybe used.

After preparing materials 1–3 of a major eraser material and an abrasive material (material 4) as described above, the following stages are practiced as the final process to obtain a product.

(1) First Stage

The following materials are milled by rolls.

| | |
|---|---|
| Material 2: | 100 parts |
| Material 3: | 90 parts |
| Sulfur: | 1.25 parts |
| Chinese white: | 0.12 part |
| Vulcanizing accelerator | 0.12 part |
| Titanium | 10 parts |

Sulfur is used for vulcanizing material 2.

(2) Second Stage

The following materials are milled by rolls.

| | |
|---|---|
| The materials milled in the first stage: | 180 parts |
| Material 1: | 90 parts |

(3) Third Stage

The following materials are milled by rolls.

| | |
|---|---|
| The materials milled in the second stage: | 270 parts |
| Abrasive material (material 4): | 210 parts |

It is preferred that a ratio of the abrasive material (material 4) with respect to the total major eraser material obtained in the second stage is about 75–about 80%.

(4) Fourth Stage

The materials milled in the third stage are vulcanized and shaped to obtain products as in the case of general rubber products.

In the products thus obtained, the materials 1—3 constituting eraser itself exist in the form of particles and a particle size of which is larger than that of the abrasive material (material 4).

A formulation in the first to fourth stages of the final process may be modified as follows:

| | |
|---|---|
| (Case 1) | |
| Material 1 | 7 parts |
| Material 2 | 11 parts |
| Material 3 | 10 parts |
| Sulfur | 0.2 part |
| Chinese white | 0.05 part |
| Vulcanizing accelerator | 0.05 part |
| Titanium white | 1 part |
| Material 4 (abrasive material) | 23 parts |
| (Case 2) | |
| Material 1 | 9 parts |
| Material 2 | 11 parts |
| Material 3 | 9 parts |
| Sulfur | 0.2 part |
| Chinese white | 0.05 part |
| Vulcanizing accelerator | 0.05 part |
| Titanium white | 1 part |
| Material 4 (abrasive material) | 23 parts |
| (Case 3) | |
| Material 1 | 8 parts |
| Material 2 | 12 parts |
| Material 3 | 9 parts |
| Sulfur | 0.2 part |
| Chinese white | 0.05 part |
| Vulcanizing accelerator | 0.05 part |
| Titanium white | 1 part |
| Material 4 (abrasive material) | 23 parts |

While three types of materials have been used as the major eraser materials in Examples 1 and 2, of course, two, four or more types of materials may also be used.

Furthermore, it is to be noted that an abrasive material may be included into particles of the major eraser materials of the present invention, if required.

What is claimed is:

1. An eraser having an integral structure composed of plural types of eraser pieces having different hardnesses and an abrasive material, said eraser pieces and said abrasive material existing respectively in a particulately dispersed state.

2. An eraser as claimed in claim 1 wherein at least one of said plural types of eraser pieces is a rubber-like substance which is prepared by mixing together such ingredients that are essentially hard to be miscible with one another.

3. An eraser as claimed in claim 2, wherein said abrasive material is prepared by either bonding a lubricating material to or allowing the same to permeate into the abrasive material.

4. An eraser as claimed in claim 1 wherein said abrasive material is prepared by either bonding a lubricating material to or allowing the same to permeate into the abrasive material.

* * * * *